US005344578A

United States Patent [19]

Wei et al.

[11] Patent Number: 5,344,578

[45] Date of Patent: Sep. 6, 1994

[54] HYDROCARBYL ETHERS OF SULFUR-CONTAINING HYDROXYL DERIVED AROMATICS AS SYNTHETIC LUBRICANT BASE STOCKS

[75] Inventors: Liwen Wei, Belle Mead; Andrew G. Horodysky, Cherry Hill; Andrew Jeng, Marlton; Ross A. Kremer, Ringoes, all of N.J.

[73] Assignee: Mobil Oil Corporation, Fairfax, Va.

[21] Appl. No.: 992,671

[22] Filed: Dec. 18, 1992

[51] Int. Cl.[5] ..... C10M 135/00

[52] U.S. Cl. ..... 252/47.5; 252/48.2

[58] Field of Search ..... 252/47.5, 48.2; 568/49, 568/18

[56] References Cited

U.S. PATENT DOCUMENTS 4,393,241 7/1983 Hanson et al. ..... 568/49

*Primary Examiner*—John Niebling
*Assistant Examiner*—Edna Wong
*Attorney, Agent, or Firm*—Alexander J. McKillop; George W. Hager, Jr.; Charles A. Malone

[57] ABSTRACT

Alkyl ethers of sulfur-containing hydroxyl-derived aromatics have been found to be effective as high-performance synthetic lubricant base stocks with superior catalytic thermal/oxidative stabilities, excellent antiwear and load-carrying properties, as exemplified by bisphenol sulfide (BPS) based products. These ethers are also highly useful in fuel compositions.

15 Claims, No Drawings

HYDROCARBYL ETHERS OF SULFUR-CONTAINING HYDROXYL DERIVED AROMATICS AS SYNTHETIC LUBRICANT BASE STOCKS

CROSS-REFERENCE TO RELATED APPLICATIONS

BACKGROUND OF THE INVENTION

This invention is directed to hydrocarbyl, particularly alkyl, ethers of sulfur-containing mono- or polyhydroxyl-derived aromatics as high performance/high temperature synthetic lubricant base stocks.

Generally speaking, current synthetic lubricants have a "satisfactory" temperature performance ceiling between about 240° C. to 260° C. in the presence of antioxidants. In the future, the operating temperatures of internal combustion engines and the like are expected to increase in order to boost the engine's efficiency. Polyphenyl ethers, for example, and other hydrocrabon fluids have such higher operating temperatures but are either cost disadvantageous or have limitations on their lubricant properties (such as poor low temp characteristics, for polyphenyl ethers). New base fluids clearly need to be developed.

Sulfurized lubricant compositions are well known in the art. U.S. Pat. No. 4,990,271 is directed to sulfur containing lubricant additives which are useful in providing antiwear, antioxidant and friction reducing properties thereto. U.S. Pat. No. 3,840,463 discloses the use of certain metal dialkyl dithiocarbamates or dithiophosphates in combination with metal-free additives containing sulfur and phosphorous.

BRIEF SUMMARY OF THE INVENTION

This application is more particularly directed to alkyl ethers of sulfur-containing mono- or polyhydroxyl-derived aromatics as having utility as high temperature, high performance synthetic lubricant base stocks, blending stocks or as additives for other base stock fluids or liquid fuels.

It has been found that alkyl ethers of sulfur-containing hydroxyl-derived aromatics possess excellent catalytic thermal/oxidative stabilities and lubricity. Catalytic thermal/oxidative testing, including DSC (Differential Scanning Calorimetry), RBOT (Rotating Bomb Oxidation Test) and Catalytic Oxidation tests gave results which showed that the instant fluids outperformed current commercial synthetic hydrocarbon fluids including alkylated aromatics and polyol esters. Four-Ball Wear and EP testing indicated that the fluids of the present invention have excellent lubricity characteristics as well as having antiwear and load-carrying properties superior to many commercial synthetic hydrocarbon fluids. All of these remarkable/superior performance advantages are believed to be direct results of 1) inherent high catalytic thermal/oxidative stabilities of aryl groups, 2) built-in sulfur functionalities, and 3) ether groups which provide antioxidancy, cleanliness, and lubricity benefits.

Additional dispersancy, detergency, antifatigue, fuel economy improving, and high temperature stabilizing properties are likely. Generally speaking it is expected that the performance benefits will include antifatigue, antispalling, antistaining, antisquaking, improved additive solubility, improved load carrying/bearing, extreme pressure, improved thermal and oxidative stability, friction reducing, antiwear, anticorrosion, cleanliness improving, low- and high-temperature antioxidant, emulsyfying/demulsifying, detergency and antifoaming properties.

Ideal lubricants suitable for high temperature operations require not only high stability base stocks, but also additives with adequate thermal properties that can maintain stability and function at high temperatures. This invention, therefore, discloses a new class of molecularly engineered, "structurally stabilized" synlube base stocks with unique R—S—$R_1$ units (R, $R_1$=aryl or alkyl) implanted into their structural backbones. These new synlubes are based on bisphenol sulfide (thiodiphenol) (BPS) and can be readily extended to other mono- or polyhydroxyl-derived sulfur-containing aromatics such as thiophenol. These compositions exhibit good potential as high temperature fluids and exhibited additional performance features such as antioxidancy and antiwear characteristics as demonstrated by catalytic thermal/oxidative stabilities (RBOT and Catalytic Oxidation testing) and lubricity (Four-Ball Wear and EP) testing.

These compositions can be used as lubricant fluids at 50–100 wt. % concentration, partial fluid replacement levels of 5–50 wt. % concentration, and as additives at levels of 0.01–10 wt. % concentration.

These compositions can, as noted hereinabove, also be used in fuels, (hydrocarbyl or hydrocarbon, oxygenated or alcoholic, or mixtures of same) to provide many of the above beneficial properties. They can be used in fuels at concentrations of 5–1,000 pounds of additive per thousand barrels of fuel or, more preferably, 20–250 lbs/1,000 barrels.

The compositions of matter in this invention are believed to be unique and novel. To the best of our knowledge, these compositions have not been previously used or reported as base stocks in aviation, automotive, marine and industrial applications or used with hydrocarbon or oxygenated fuels.

Therefore, it is an object of this invention to provide improved lubricant and fuel compositions comprising the above-described sulfur-containing aromatics.

DESCRIPTION OF PREFERRED EMBODIMENTS

Alkyl ethers of sulfur-containing aromatics were prepared via an interfacial method by reacting hydroxyl-derived aromatics with alkyl halides in the presence of a phase transfer catalyst as described below:

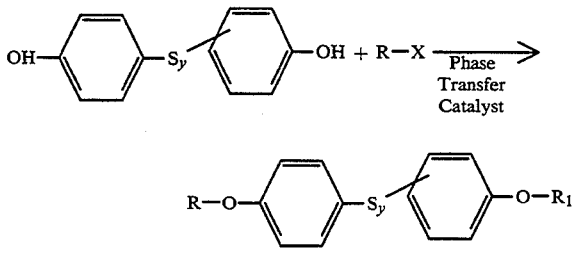

Where R, $R_1$ are hydrogens or $C_1$ to $C_{30}$ hydrocarbyl, preferably C3 to C10 straight chain or branched, and optionally contain sulfur, nitrogen and/or oxygen; X=Cl, Br, I; PT Catalyst: $R_2R_3R_4R_5N+X^-$, $R_2$, $R_3$, $R_4$, $R_5$=$C_1$ to $C_{20}$ hydrocarbyl, $X^-$=anions. R and $R_1$ can be the same or different. y can be 1 to 3, preferably 1. R and $R_1$ are usually aliphatic with either linear or branched structures. The combinations of R and $R_1$ are critically important in providing satisfactory viscometric properties. Other methods of making similar ethers can also be used to prepare the compositions of this invention, and can be found in the chemical literature. The para-substituted thiodiphenol is shown only for illustration purposes. Linkages could be ortho or para or both in varying degrees. Some monoethers can also be present and can be advantageous. Other isomers can be used, accordingly, as related sulfur-containing hydroxy- substituted aromatics. Mixtures can be used, and can, on occasion, be preferred to more pure raw materials. The compounds in accordance with the invention can also be made by the direct etherification of the S-containing phenols olefins, or other ether forming species.

Any suitable hydroxyl-derived sulfur-containing aromatic compound may be used. Included in this group are such compounds as bisphenol sulfide, thiophenol, bisphenols, e.g., bisphenol A, and the like.

Any suitable hydrocarbyl halide may be used, however, alkyl halides are preferred. Suitable halides include but are not limited to 2-methylbutyl bromide, 2-ethylhexyl bromide, n-butyl bromide , 2-butyl bromide, octyl bromide, decyl bromide, cyclohexyl bromide, or corresponding chlorides and the like.

Suitable phase transfer catalysts which accelerate the reaction and improve yields include but are not limited to quaternary ammonium salts such as benzyltriethylammonium chlorides, tetrabutylammonium bromide, cyclic polyethers, poly(ethylene oxides), polyether-amines where the amine is a tertiary-amine or mixture thereof and the like. Preferred are tri- or tetrahydrocarbyl ammonium chlorides or bromides such as tricaprylylmethylammonium chloride or tetrabutylammonium bromide.

Conditions for the reactions in accordance with the invention may vary widely depending upon specific reactants, the presence or absence of a solvent and the like. Any suitable set of reaction conditions known to the art may be used. Generally, stoichiometric quantities of reactants are used. However, equimolar, more than molar or less than molar amounts may be used. More specifically, an excess of one reagent or another can be used and molar quantities, less than molar quantities or more than molar quantities of either a phosphite, a phenol, an amine, or a carbonyl coupling agent can be used. The reaction temperature may vary from ambient to about 250° C.; the pressure may vary from less than ambient or autogenous to about 1,000 psig and the molar ratio of reactants preferably varies from about 5:1 moles to about 1:5 moles.

Any suitable hydrocarbon solvent may be used if desired. Suitable solvents include any convenient hydrocarbon solvent such as toluene and hexane.

The additives embodied herein are utilized in lubricating oil or grease compositions in an amount which imparts significant antiwear characteristics to the oil or grease as well as reducing the friction of engines operating with the oil in its crankcase. Concentrations of about 0.001 to about 10 wt. % based on the total weight of the composition can be used. Preferably, the concentration is from 0.1 to about 3 wt. % when used as additives. These compositions can also be used as lubricating fluids comprising about 10–99+ wt. % of the reaction product. They can be used admixed with mineral oils and/or other synthetic fluids. They can be further additized to improved lubricating characteristics.

The additives have the ability to improve the above noted characteristics of various oleagenous materials such as hydrocarbyl lubricating media which may comprise liquid oils in the form of either a mineral oil or a synthetic oil, or in the form of a grease in which the aforementioned oils are employed as a vehicle.

In general, mineral oils, both paraffinic, naphthenic and mixtures thereof, employed as the lubricant, or grease vehicle, may be of any suitable lubricating viscosity range, as for example, from about 45 SSU to about 6000 SSU at 100° F. and preferably, from about 50 to about 250 SSU at 210° F. These oils may have viscosity indexes preferably ranging to about 95. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing grease in accordance with the present invention. The composition of this invention can be employed as the vehicle for the grease, either alone or admixed with other grease vehicles.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether and phenoxy phenylethers.

It is to be understood, however, that the compositions contemplated herein can also contain other materials. For example, corrosion inhibitors, extreme pressure agents, low temperature properties modifiers and the like can be used as exemplified respectively by metallic phenates or sulfonates, polymeric succinimides, nonmetallic or metallic phosphorodithioates and the like. These materials do not detract from the value of the compositions of this invention, rather the materials serve to impart their customary properties to the particular compositions in which they are incorporated. These materials can be used in engine oils, marine oils, aviation lubricants, industrial gear, compressor, way, hydraulic, and other lubricant applications as well as in selected fuels.

The following examples are merely illustrative and are not meant to be limitations.

EXAMPLE 1

A mixture of 2-methylbutyl bromide (151 g) and 2-ethylhexyl bromide (193 g) was added by portions into an aqueous mixture containing bisphenol sulfide (218 g), KOH (150 g, 85%), tetrabutylammonium bromide (10 g), and water (150 g) at 70° C. under nitrogen with stirring. The resulting mixture was stirred and maintained at 70° C. for 24 hours, and at the end of the reaction, was cooled to ambient temperature. Approximately 200 g of water was added, and separated to give crude liquid product. This livid was further washed with 3×100 ml water and light ends were removed at 160° C., 1 torr and then filtered through alumina (neutral) to give a clear and colorless liquid (395 g) in high yield. Products were further characterized by GC, GC/MS and IR. Kv @100:=5.8 cSt, VI=45, pour point−34+ C.

EXAMPLE 2

All procedures were the same as the above Example 1 except the mixture of alkyl halides used were: butyl bromide (137 g), hexyl bromide (165 g), octyl bromide (193 g), and 2-ethylhexyl bromide (193 g). The product was characterized by: Kv@100:=5.8 cSt, VI=74, and pour point=−49° C.

EXAMPLE 3

All procedures were the same as the above Example 1 except the mixture of alkyl halides were 2-ethylhexyl-bromide (193g) and decyl bromide (221 g). These products were dialkyl thiodiphenol ethers (by Gc) yet in solid forms.

EXAMPLE 4

All procedures were the same as the above Example 1 except the mixture of alkyl halides were 2-ethylhexyl-bromide (193 g), octylbromide (68.9 g), decyl-bromide(73.6 g) and dodecylbromide (78.3 g). Products were dialkyl thiodiphencl ethers yet in solid forms.

Evaluation of Products

Alkyl bisphenol sulfide ethers obtained as described above were evaluated as high-performance base stocks by the Differential Scanning Calorimetry (DSC Table 3), Catalytic Oxidation Test and Rotary Oxidation Bomb Oxidation Test (Table 1), and Four-Ball Wear and EP tests (Table 2). Comparisons of the thermal/oxidative stabilities and lubricity of these ethers with commercial synthetic lubricant base stocks were made. The use of these ethers as blending/additive components (1 to 30%) was also examined by Four-Ball Wear test (Table 3).

In the Differential Scanning Calorimetry test method (DSC), the environment of a sample is either heated or cooled at a linear rate (i.e., the "scanning" part). During the scan, the energy uptake or release by the sample is compared quantitatively (i.e., calorimetrically) with an inert material (i.e., differentially). It is used herein to the onset of oxidation of the test material. For more complete information, please refer to SAE Technical Paper Series, NO. 801383, "Characterization of Lubricating Oils by Differential Scanning Calorimetry," by Walker et al., Oct. 20-23, 1980, and to the Journal of the Institute of Petroleum, Vol. 57, No. 558, November 1971, pages 355-358, "The Characterization of Lube Oils and Fuel Oils by DSC Analysis," by F. Noel, Imperial Oil Enterprises Ltd, Ontario, Canada) which was part of a presentation made at the ASTM D-2 Symposium in Dallas, Tex., Dec. 7, 1970.

The Catalytic Oxidation Test may be summarized as follows: Basically, the lubricant is subjected to a stream of air which is bubbled through the oil formulation at the rate of five liters per hour at 325° F. for 40 hours. Present in the composition are samples of metals commonly used in engine construction, namely iron, copper, aluminum and lead, see U.S. Pat. No. 3,682,980 incorporated herein by reference for further details.

The Rotary Bomb Oxidation Test identified as ASTM D2272 may be summarized as follows: This test method is a rapid means for estimating the oxidation stability of (turbine) oils. Test oil, water and a copper catalyst coil in a covered glass container are placed in a bomb equipped with a pressure gauge. The bomb is generally charged with oxygen to a pressure of 90 psi and placed in a constant temperature oil bath and rotated axially at 100 rpm at an angle of 30 deg from the horizontal. The time for the test oil to react with a given volume of oxygen is measured, completion of the time is indicated by a specific drop in pressure.

The Four Ball Wear Test is in accordance ASTM D2266, for details see also U.S. Pat. No. 4,761,482. The K factor is determined as shown below.

Wear Coefficient K

Dimensionless K is defined as $$K = \frac{VH}{dW}$$

where

V=wear volume, mm3

H=hardness 725 kg/mm2 for 52100 steel d=(23.3 mm/rev) (RPM×Time)

W=(0.408) (Load in kg)

The wear volume V will be calculated from the wear scar diameter D in man as follows:

$$V=[15.5\ D^3-0.0103L]D\times 10^{-3}\ \text{mm}^3$$

where L is the machine load in kg. This equation considers the elastic deformation of the steel balls. For a 60 kg load, the equation is $$V=[15.5D^3-0.618]D\times 10^{-3}\ \text{mm}^3$$

The Four-Ball EP Test (ASTM D-2783) measures the extreme pressure characteristics of a lubricant by a Load Wear Index (LWI) and a weld point or load. A test ball is rotated under load at a tetrahedral position on top of three stationary balls immersed in lubricant. Measurements of scars on the three stationary balls are used to calculate LWI's, and the weld is the load at which the four balls weld together in 10 seconds. The higher the value the better.

TABLE 1

Rotary Bomb Oxidation and Catalytic Oxidation Tests

| Fluid | ASTM D2272, RBOT (min) | Catalytic Oxidation Test (325° F., 40 hr) (% Kv @ 40° C. Change) |
|---|---|---|
| Example 1 | 4115 | 1.2 |

TABLE 1-continued

| Rotary Bomb Oxidation and Catalytic Oxidation Tests | | |
|---|---|---|
| Fluid | ASTM D2272, RBOT (min) | Catalytic Oxidation Test (325° F., 40 hr) (% Kv @ 40° C. Change) |
| Example 2 | 7050 | 4.6 |
| Trimethylolpropane derived polyol ester | 686 | 23 |
| Pentaerythritol derived polyol ester | 482 | 139 |
| Polyalphaolefins | 53 | 230 |

TABLE 2

| Four-Ball Wear and EP Tests | | | | |
|---|---|---|---|---|
| | Four-Ball | Four-Ball EP Test | | |
| Fluid | Wear Test K factor (E10-8) | Last Non-Seizure Load (Kg) | Load Wear Index (LWI) | Weld Load (Kg) |
| Example 2 | 9 | 80 | 34 | 160 |
| Alkylated aromatics | 814 | 24 | 12 | 126 |
| Polyalpha-olefins | 402 | 50 | 23 | 126 |

These results showed that Example 2 can be used in smaller concentrations in Fluid Y (10% Example 2) or Fluid X (30% Example 2) and give comparable antiwear characteristics as that of neat Example 2.

TABLE 3

| DSC, 80° C.-350° C. @ 5°/min. 500 psi | | | | |
|---|---|---|---|---|
| | Alkyl Side Chain Branching | n-CBr | Physical State (Pour Point) | Oxidation Onset Temperature |
| Example 1 | 100% | O | −34° C. | 45 |
| Example 2 | 50% | $C_4/C_6/C_8$ | −49° C. | 245°-250° C. |
| Example 3 | 50% | $C_{10}$ | Solid | |
| Example 4 | 50% | $C_8/C_{10}/C_{12}$ | Solid | |
| Polyphenyl ether Monsanto | | | | |
| OS138 | | | 15° C. | |
| OS124 | | | 10° C. | |
| TMP ester | | | | 216 |
| PE ester | | | | 193 |
| PAO | | | | 170 |

As demonstrated by these tests, these sulfur-containing alkyl aryl ethers provide significantly enhanced catalytic thermal/oxidative stabilities, antiwear and load-carrying properties, and can be of great value in developing high-temperature/performance lubricant base stocks for aviation, automotive, marine and industrial applications. Their good and flexible viscometrics (Examples 1 and 2) will have practical advantages over polyphenyl ethers, which are commercial high cost and high temperature (fluids) lubricants with both poor viscometrics and low temperature properties. The novel fluids disclosed in this invention can also be used as blending or additive components providing sulfur additive benefits such as antiwear. These novel compositions can be readily made using known phase transfer catalysis technology as commercially practiced by many chemical industries or by direct addition of olefins to form the corresponding ethers.

TABLE 4

| Blending Study by Four-Ball Wear Test | | |
|---|---|---|
| Example 2, wt % | Fluid X, Concentration = 100% - Example 2 K factor (× 10E-8) | Fluid Y, Concentration = 100% - Example 2 K factor (× 10E-8) |
| 0 | 814 | 402 |
| 1 | 537 | 442 |
| 5 | 304 | 293 |
| 10 | 310 | 6 |
| 20 | 230 | 5 |
| 30 | 7 | 6 |
| 100 | 9 | 9 |

Although the present invention has been described with preferred embodiments, it is to be understood that modifications and variations may be resorted to, without departing from the spirit and scope of this invention, as those skilled in the art will readily understand. Such variations and modifications are considered within the purview and scope of the appended claims.

What is claimed is:

1. A method of preparing a lubricant composition comprising adding to a lubricant of lubricating viscosity or grease and an effective amount of an additive product of reaction prepared by reacting a hydroxyl-derived aromatic with an alkyl halide in the presence of a phase transfer catalyst as described below;

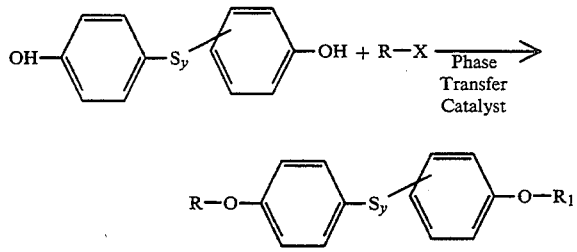

where R, $R_1$ are hydrogen or $C_1$ to $C_{30}$ hydrocarbyl and optionally contain sulfur, nitrogen and/or oxygen; X=Cl, Br, I; R and $R_1$ can be the same or different, and at least one of R or $R_1$ must be hydrocarbyl and y=1-3, and wherein the reaction is carried out at temperatures varying from ambient to about 250° C. under pressures varying from ambient to about 1,000 psig or is autogenous for a time sufficient to obtain the desired additive product of reaction and wherein the reaction is carried out in molar ratios of reactants varying from equimolar to more than molar to less than molar thereby obtaining an aromatic additive product containing hydrocarbyl ethers of a sulfur-containing hydroxyl-derived aromatic that imparts to said lubricant improved catalytic thermal/oxidative stabilities, concomitantly with improved antiwear and load-carrying properties.

2. The method of claim 1 wherein the phase transition catalyst is selected from a member of the group consisting of quaternary ammonium salts, cyclic polyethers, poly (ethylene oxides) and polyether amines.

3. The method of claim 1 wherein the phase transition catalyst is selected from tri- or tetrahydrocarbyl ammonium chlorides or bromides.

4. The method of claim 1 wherein the alkyl halide comprises 2-methylbutyl bromide or 2-ethylhexyl bromide, the hydroxyl-derived aromatic is bisphenol sulfide and the catalyst is tetrabutylammonium bromide.

5. The method of claim 1 wherein the alkyl halide comprises butyl bromide, hexyl bromide, octyl bromide and ethylhexyl bromide or mixtures thereof and the catalyst is tetrabutylammonium bromide.

6. The method of claim 1 where said lubricant of lubricating viscosity comprises a synthetic lubricant or a blending stock.

7. The method of claim 1 wherein said composition is a synthetic base stock comprising at least about 50 wt % to about 99 wt %, based on the total weight of the composition of said hydrocarbyl ethers of sulfur containing hydrocarbyl-derived aromatic reaction products.

8. The method of claim 1 wherein said composition is a synthetic lubricant basestock comprising a major proportion of said hydrocarbyl ethers admixed with a minor proportion of an oil of lubricating viscosity selected from the group consisting of (1) mineral oils, (2) synthetic oils, (3) or mixtures of mineral and synthetic oils or a grease prepared from any one of (1), (2) or (3).

9. The method of claim 8 wherein said composition is a synthetic lubricant basestock that is admixed with an oil selected from the group consisting of alkylated aromatics and polyalphaolefins.

10. The method of claim 8 wherein said composition is a synthetic lubricant basestock that is admixed with a mineral oil.

11. The method of claim 1 wherein the composition comprises a lubricant containing, 10 wt % or less to about 30 wt %, based on the total weight of the composition of said hydrocarbyl ethers added to an oil of lubricating viscosity as an additive.

12. The method of claim 1 wherein said hydrocarbyl ethers are derived from a sulphur containing phenol.

13. The method of claim 12 wherein said sulfur containing phenol is bisphenol S.

14. The method of claim 13 where said lubricant composition additionally contains from about 10 to about 20 wt %, based on the total weight of the composition, of other known additives for their known purposes.

15. A method for improving the high temperature stability and anti-wear activity of lubricants by adding an effective amount of the reaction product claimed in claim 1.

* * * * *